United States Patent [19]

Freiberg

[11] Patent Number: 4,462,196

[45] Date of Patent: Jul. 31, 1984

[54] MEANS FOR INTERCONNECTING PANELS

[75] Inventor: Peter C. Freiberg, South Perth, Australia

[73] Assignee: P.C. Freiberg Pty. Ltd., Bayswater, Australia

[21] Appl. No.: 389,472

[22] Filed: Jun. 17, 1982

[30] Foreign Application Priority Data

Jun. 18, 1981 [AU] Australia ..... PE9348

[51] Int. Cl.[3] ..... F04C 1/10

[52] U.S. Cl. ..... 52/586; 52/122.1

[58] Field of Search ..... 52/582, 586, 730, 731, 52/122.1; 49/DIG. 1

[56] References Cited

U.S. PATENT DOCUMENTS 4,117,640 10/1978 Vanderstar ..... 49/DIG. 1

FOREIGN PATENT DOCUMENTS 1113551 4/1958 Fed. Rep. of Germany ..... 52/730

*Primary Examiner*—John E. Murtagh
*Assistant Examiner*—Kathryn L. Ford
*Attorney, Agent, or Firm*—Fleit, Jacobson, Cohn & Price

[57] ABSTRACT

Means for interconnecting adjacent panels of partitioning comprising a flanged member adapted to be secured to or formed integral with the vertical edges of each panel, each flanged member being provided with one or more flanges which mate with corresponding flanges of the flanged member of an adjacent panel to prevent separation of the adjacent panels along the line of the panels, each flanged member also being provided with an open longitudinal channel adapted to abut with a similar open longitudinal channel on the flanged member on the adjacent panel to define a closed channel when in the mating position and a locking strip adapted for engagement in the closed channel to prevent separation of the flanged members in a direction substantially at right angles to the line of the panels.

14 Claims, 9 Drawing Figures

MEANS FOR INTERCONNECTING PANELS

This invention relates to means for interconnecting adjacent panels of partitioning.

It is an object of this invention to provide means for interconnecting adjacent panels of partitioning which means has a neat external appearance in the assembled condition and provides a strong connection capable of easy assembly and disassembly.

In one form the invention resides in means for interconnecting adjacent panels of partitioning comprising a flanged member adapted to be secured to or formed integral with the vertical edges of each panel, each flanged member being provided with one or more flanges which mate with corresponding flanges of the flanged member of an adjacent panel to prevent separation of adjacent panels along the line of the panels, each flanged member also being provided with an open longitudinal channel adapted to abut with a similar open longitudinal channel on the flanged member on the adjacent panel define a closed channel when in the mating position, and a locking strip adapted for engagement in the closed channel to prevent separation of the flanged members in a direction substantially at right angles to the line of the panels.

According to a preferred feature of the invention a cap is adapted to be positioned at one end of the mating flanged members, said cap comprising a body having means for engaging the flanged members to prevent relative movement therebetween parallel to the longitudinal axis of the mating flanged members, and an opening in the body adapted to align with said closed channel to permit insertion and withdrawal of the locking strip.

The invention will be better understood by reference to the following description of one specific embodment thereof as shown in the accompanying drawings wherein.

Figure 1:
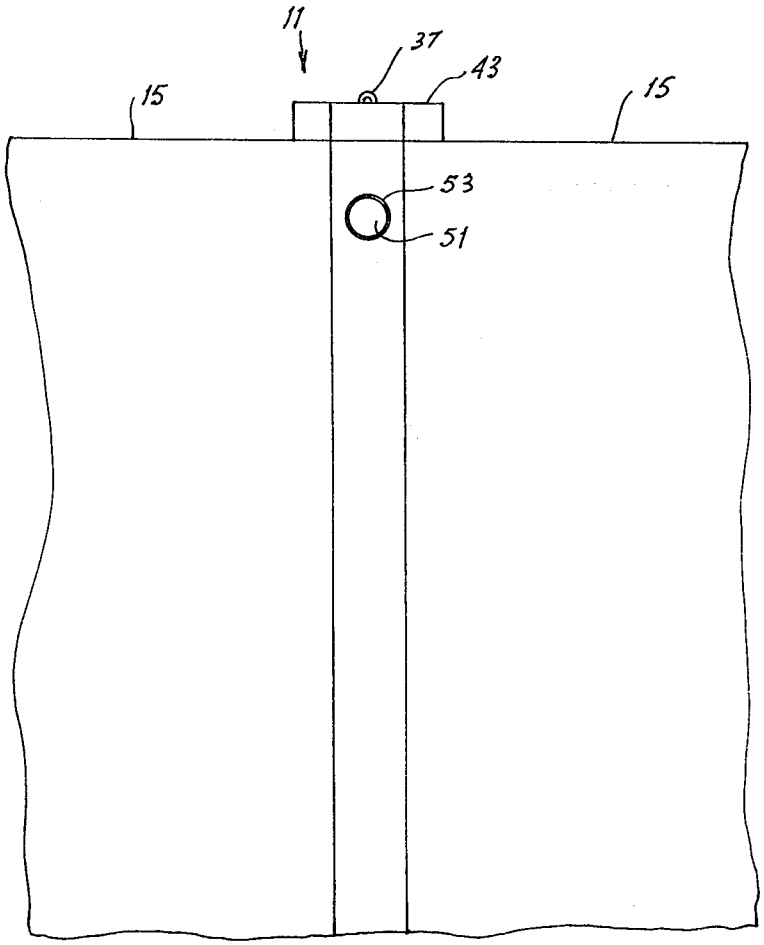
FIG. 1 is a fragmentary elevational view of a pair of partitioning panels interconnected by means according to the invention.
Figure 2:
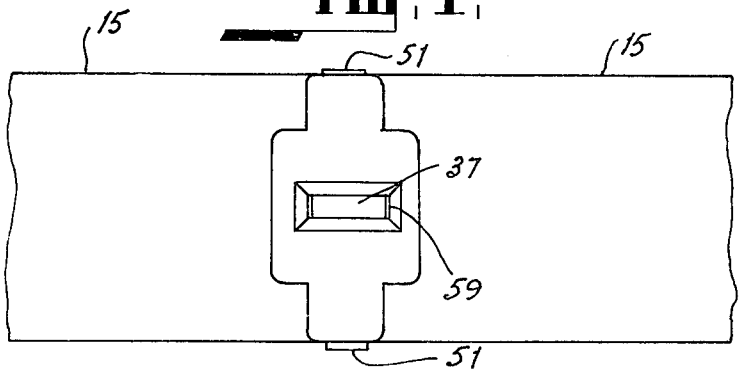
FIG. 2 is a plan view of FIG. 1.

The embodiment shown in the drawings is directed to a means for interconnecting adjacent partitioning panels of the form typically used in offices and the like, in edge to edge relation.

Figure 7:
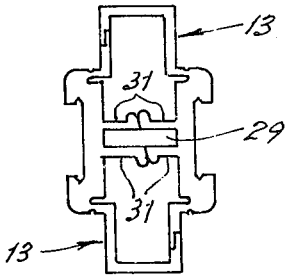
FIG. 7 is an end view of the pair of flanged members in the mating position.
Figure 8:
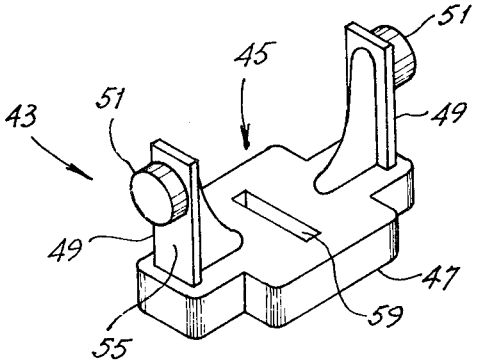
FIG. 8 is a perspective view of the cap illustrating the underside thereof.

Referring to the drawings, the connection means 11 comprises a pair of identical flanged members 13 which are arranged to be secured to vertical edges of adjacent panels 15. Each flanged member 13 is provided with an outwardly extending flange 17 and an inwardly extending flange 19, the orientation of the flanges 17 and 19 being such that the flanges are disposed substantially at right angles to the line of the panels when the flanged members are secured to the panels. The flanged members 13 are adapted for mating engagement (as shown in FIG. 7) with the outwardly extending flange 17 of each flanged member mating with the inwardly extending flange 19 of the other respective flanged member to prevent separation of adjacent panels along the line of the panels. Each flanged member more specifically comprises an intermediate portion 21 and an edge portion 23 at each side of the intermediate portion and upstanding therefrom. The flanges 17 and 19 are formed at the outer ends of the respective edge portions 23. The free ends of each flange is rebated to define a lip 25 of reduced thickness to that of the remainder of the flange. When the flanged members are in the mating position, the respective lips 25 are in abutting relation.

Each flanged member is formed with an open longitudinal channel 27. When the flanged members are in the mating position, the respective longitudinal channels 27 are adapted to abut to define a closed channel 29 (as best seen in FIG. 7). In the illustrated arrangement each open longitudinal channel 27 comprises a pair of spaced legs 31 upstanding from the intermediate portion 21. The outer ends of the legs 31 are each formed with a lip 33 the outer surface of which defines an abutting face 35. The leg 31*a* which is closer to the inwardly extending flange 19 is of greater length than the other leg 31*b*. The abutting faces 35 of corresponding legs are adapted to abut when the flanged members are in the mating position. The abutting faces 35 are inclined towards their respective inturned flange to facilitate positioning of the flanged members in the mating position.

A locking strip 37 is adapted for insertion in the closed channel 29 to prevent separation of the flanged members in a direction substantially at right angles to the line of the panels. The locking strip 37 is preferably formed from resilient material and in the illustrated arrangement is of a length of such material folded back upon itself. The closed end 39 of the folded length of resilient material defines a head 41.

Figure 3:
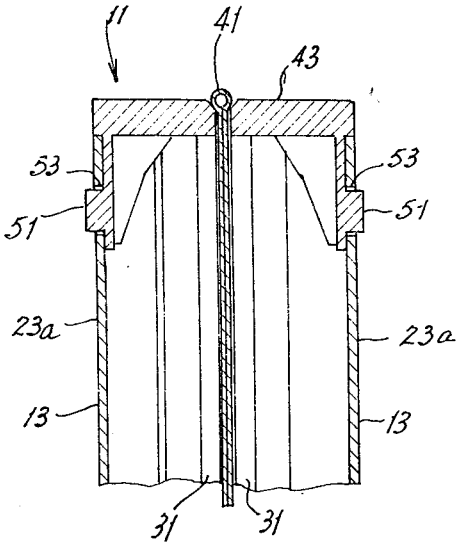
FIG. 3 is a fragmentary cross-sectional elevation of the connection means.
Figure 4:
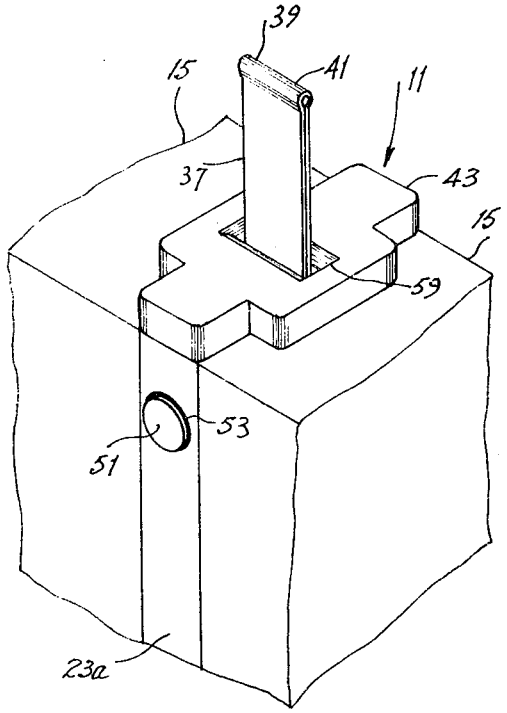
FIG. 4 is a fragmentary perspective view illustrating the arrangement of FIG. 1, except that the locking strip is shown in a partly withdrawn position.
Figure 5:
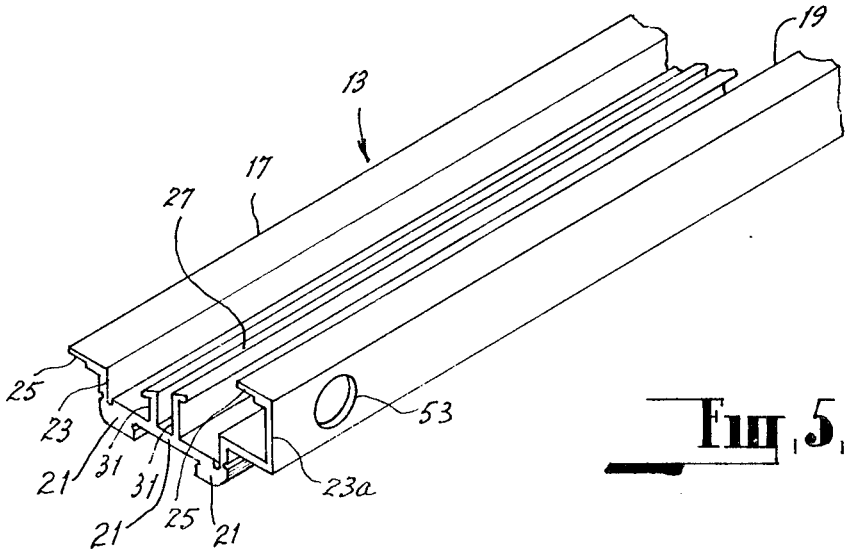
FIG. 5 is a fragmentary perspective view of one flanged member.
Figure 6:
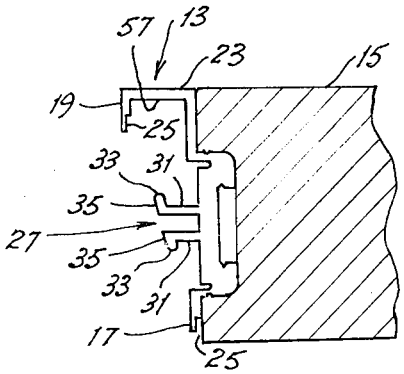
FIG. 6 is a fragmentary plan view illustrating the flanged member mounted on one of the panels.

A cap 43 is adapted to be positioned at the upper end of the mating flanged members 13. The cap includes a body 45 having a head 47 and a pair of legs 49. As is best seen in FIG. 3 when the cap 43 is in position the head is adapted to seat against the adjacent ends of the mating flanged members with the legs 49 extending into the region defined within the mating flanged members. Each legs 49 is provided with an outwardly projecting spigot 51 which is adapted to locate in a complementary hole 53 formed in the edge portion 23*a* associated with the inwardly directed flange 19. When the cap is in position, the outer faces 55 of the legs 49 are disposed in face to face abutting relation with the inner faces 57 of the respective edge portions 23*a* of the flanged members (as best seen in FIG. 3). The effect of the cap 43 is to lock the mating flanged members against relative movement in a direction parallel to their respective longitudinal axes.

Figure 9:
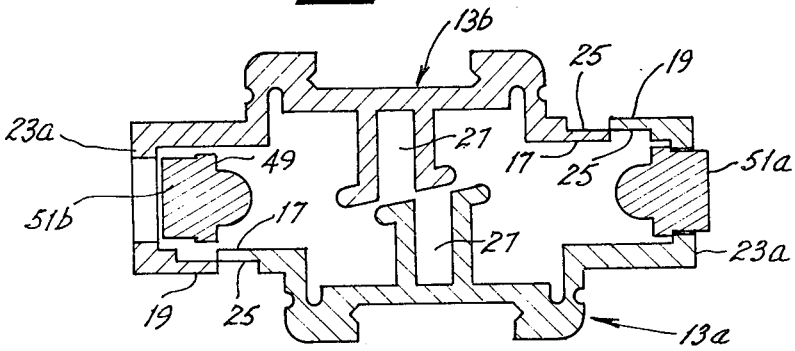
FIG. 9 is a cross-sectional view on an enlarged scale of the pair of flanged members and cap, illustrating the relative positions of the flanged members in readiness to assume the mating position.

There is formed in the head 47 of the cap an opening 59 which is adapted to align with the closed channel 29 defined by the open channels 27 when the flanged members are in the mating position. The purpose of the opening 59 is to permit the locking strip 37 to be inserted into and withdrawn from the closed channel when the cap 43 is in position. The outer end of the opening 59 is enlarged and the surrounding part of the head 47 of the cap shaped to form a seat for the head 41 of the locking strip. To connect a pair of panels of partitioning in edge to edge relation, the flange members 13 are first mounted on the respective edges of the panels. The cap is installed in position on the top end of one of the flanged members (flange member 13*a* in FIG. 9) and the panels and flanged members then positioned so that outwardly extending flange 17 of each flange member is aligned for engagement with the inwardly extending flange 19 of the other flanged member in the direction substantially at right angles to the line of the panels (as shown in FIG. 9). At this stage, the spigot 51*a* of the cap 43 is located in the hole 53 of the flanged member 13*a* (this being the flanged member on which the cap was positioned) and the spigot 51*b* is aligned with, but not received in, the hole in the other flanged member 13*b*. The flanged members are then moved relative to each other in the direction at right angles to the panels to cause the flanged members to adopt the mating position (as shown in FIG. 7) with the outwardly directed flange 17 of each flanged member engaged with the inwardly directed flange 19 of the other flange member. As the flanged members move into the mating position, the spigot 51*b* enters the complementary hole 53 on the flanged member 13*b;* the installation of the cap is completed when the flange members assume the mating position. The connection is completed by inserting the locking strip 37 into the closed channel through the opening 59 of the cap. The mating engagement between the flanges restrains the flanged members against separation along the line of the panels, the interaction of the locking strip and the respective channels restrains the flanged members against separation substantially at right angles to the plane of the panels and the cap restrains the flanged members against relative movement in a direction substantially parallel to their respective longitudinal axes. The cap also serves to provide a neat finish at the top end of the flanged members. The outer face of the particular side portion 23*a* of each flange member is exposed when the connection means is in the assembled condition and provides the connection between the panels with a neat external appearance.

As mentioned hereinbefore, the channels 27 abut when the flanged members are in the mating position. The abutting action of the channels restrains the flanged members against relative movement towards each other. The abutting faces 35 of the channels are inclined to permit the channels to move into abutting relation as the flanged members are moved sidewardly to assume the mating position.

To dismantle the panels, the head 41 of the locking strip is gripped and the locking strip is withdrawn from within the channels 27. The panels are then moved sidewardly so as to cause the flanged members to separated. The cap may then be removed.

It should be appreciated that the scope of the invention is not limited to the scope of the particular embodiment described and that various alterations and modifications may be made without departing from the scope of the invention. For example, although the flanged members have been described in the embodiment as being arranged for mounting on the vertical edges of the panels, they may in an alternative arrangement be formed integral with the panels.

I claim:

1. Means for interconnecting adjacent panels of partitioning comprising a flanged member adapted to be secured to or formed integral with the vertical edges of each panel, each flanged member being provided with one or more flanges which mate with corresponding flanges of the flanged member of an adjacent panel to prevent separation of the adjacent panels along the line of the panels, each flanged member also being provided with an open longitudinal channel adapted to abut with a similar open longitudinal channel on the flanged member on the adjacent panel to define a closed channel when in the mating position and a locking strip adapted for insertion in the closed channel to prevent separation of the flanged members in a direction substantially at right angles to the line of the panels and a cap for positioning at one end of the mating flange members, said cap comprising a body having means for engaging the flanged members to prevent relative movement therebetween parallel to the longitudinal axis of the mating flanged members, and an opening in the body adapted to align with said closed channel to permit insertion and withdrawal of the locking strip.

2. Means as claimed in claim 1 wherein each flanged member has two said flanges one of which extends outwardly and the other of which extends inwardly.

3. Means as claimed in claim 2 wherein each flanged member includes an intermediate portion and an edge portion at each longitudinal side of the intermediate portion and upstanding therefrom substantially parallel to the line of the panels, said flanges being provided at the outer ends of the respective edge portions.

4. Means as claimed in claim 1 wherein said open longitudinal channel is defined by a pair of spaced legs extending outwardly substantially parallel to the line of the panels.

5. Means as claimed in claim 4 wherein the outer ends of said legs are formed with lips defining respective abutting faces, said abutting faces being aligned and inclined towards the inturned flange of the flanged member.

6. Means as claimed in claim 1 wherein the locking strip is formed of resilient material.

7. Means as claimed in claim 1 wherein said means for engaging the flanged members comprises a pair of opposed outwardly extending spigots each of which is adapted to locate in an opening in a respective one of the flanged members and wherein said body comprises a head and a pair of legs projecting from the head, each leg supporting one said spigot, the arrangement being such that the head is adapted to seat against one end of the mating flanged members with the legs extending into the region defined within the mating flanged members.

8. Means as claimed in claim 7 wherein the outer face of each leg is adapted to locate in face to face abutting relation with the inner face of the adjacent edge portion of a respective one of the flanged members.

9. Means for interconnecting adjacent panels of partitioning comprising a flanged member adapted to be secured to or formed integral with the vertical edges of each panel, each flanged member being provided with an inwardly extending flange and an outwardly extending flange which flanges mate with corresponding flanges of the flanged member of an adjacent panel to prevent separation of the adjacent panels along the line of the panels, each flanged member also being provided with an open longitudinal channel adapted to abut with a similar open longitudinal channel on the flanged member on the adjacent panel to define a closed channel when in the mating position and a locking strip adapted for engagement in the closed channel to prevent separation of the flanged members in a direction substantially at right angles to the line of the panels wherein said open longitudinal channel is defined by a pair of spaced legs extending outwardly substantially parallel to the line of the panels, the outer ends of said legs are formed with lips defining respective abutting faces, said abutting faces being aligned and inclined towards the inwardly extending flange.

10. means as claimed in claim 9, wherein each flanged member includes an intermediate portion and an edge portion at each longitudinal side of the intermediate portion and upstanding therefrom substantially parallel to the line of the panels, said flanges being provided at the outer ends of the respective edge portions.

11. Means as claimed in claim 9, wherein the locking strip is formed of resilient material.

12. Means as claimed in claim 9, wherein a cap is adapted for positioning at one end of the mating flange members, said cap comprising a body having means for engaging the flanged members to prevent relative movement therebetween parallel to the longitudinal axis of the mating flanged members, and an opening in the body adapted to align with said closed channel to permit insertion and withdrawal of the locking strip.

13. Means as claimed in claim 12, wherein said means for engaging the flanged members comprises a pair of opposed outwardly extending spigots each of which is adapted to locate in an opening in a respective one of the flanged members and wherein said body comprises a head and a pair of legs projecting from the head, each leg supporting one said spigot, the arrangement being such that the head is adapted to seat against one end of the mating flanged members with the legs extending into the region defined within the mating flanged members.

14. Means as claimed in claim 13, wherein the outer face of each leg is adapted to locate in face to face abutting relation with the inner face of the adjacent edge portion of a respective one of the flanged members.

* * * * *